United States Patent [19]

Kolbensvik et al.

[11] 3,933,399

[45] Jan. 20, 1976

[54] DISPLAY STAND FOR ARTICLES OF MERCHANDISE

[75] Inventors: Joel Robert Kolbensvik, Dallas; Carole Oman Greene, McKinney, both of Tex.

[73] Assignee: Application Calculators Incorporated, Dallas, Tex.

[22] Filed: Apr. 30, 1974

[21] Appl. No.: 465,691

[52] U.S. Cl. ..... 312/223; 312/196; 312/279

[51] Int. Cl.[2] ..... A47B 13/08

[58] Field of Search ..... 312/114, 117, 126, 196, 312/279, 295, 223; 35/50; 206/45.15, 305, 45.14

[56] References Cited

UNITED STATES PATENTS

| | | | |
|---|---|---|---|
| 926,298 | 6/1909 | Simon | 312/114 |
| 1,376,506 | 5/1921 | Beskin | 312/114 |
| 2,300,411 | 11/1942 | Dubey | 206/45.14 |
| 2,375,043 | 5/1945 | Shaffer | 312/117 |
| 2,465,013 | 3/1949 | Epstein | 312/114 |
| 2,582,575 | 1/1952 | Young | 312/315 |
| 3,858,726 | 1/1975 | Rosenwein | 206/45.15 |

*Primary Examiner*—Paul R. Gilliam
*Assistant Examiner*—Kenneth J. Dorner
*Attorney, Agent, or Firm*—Richards, Harris & Medlock

[57] ABSTRACT

A display stand for articles of merchandise, such as electronic calculators, which prospective customers may be expected to operate in order to test the suitability of the merchandise. The display stand comprises a housing having back and end walls and a front panel which is pivotally mounted along its top edge to permit the bottom edge to be moved outwardly from the back and end walls of the housing. The top of the display stand comprises a display shelf pivotally mounted along its bottom edge to permit the top edge to be moved between a first position in which it is in overlapping relationship with the front panel and a second position which permits access to the interior of the housing. A lock is provided on the top panel to permit securing of the top panel and the display shelf in the overlapping position to preclude access to the interior of the housing which includes a source of electrical power in the form of a typical 115 volt AC outlet. The display shelf is adapted to have articles of merchandise, such as the electronic calculators earlier mentioned, securely attached to it by screws or the like which pass through the display shelf. The display shelf is provided with an aperture which permits communication of the electrical power from the interior of the housing to the calculator to provide it with power during usage by prospective customers.

7 Claims, 3 Drawing Figures

DISPLAY STAND FOR ARTICLES OF MERCHANDISE

BRIEF SUMMARY OF THE INVENTION

The invention may be generally described as a display stand for merchandise which prospective customers may be expected to operate in order to test the suitability of the merchandise. The display stand comprises a housing having a display shelf which forms part of the housing and is so oriented that merchandise may be displayed upon the top surface of the shelf. Means are provided for mounting the display shelf to the housing to permit the shelf to be moved between a first position which exposes the top and bottom surfaces of the shelf to permit secure mounting of the merchandise on the shelf and a second position in which only the top surface of the shelf is exposed to a prospective customer in order to prevent removal of merchandise from the shelf by the prospective customer. The display shelf may also be provided with an aperture which will permit communication of a source of electrical power provided in the display stand to the merchandise displayed upon the display shelf when electrical power is needed to operate the merchandise.

DETAILED DESCRIPTION OF A PREFERRED EMBODIMENT

Figure 1:
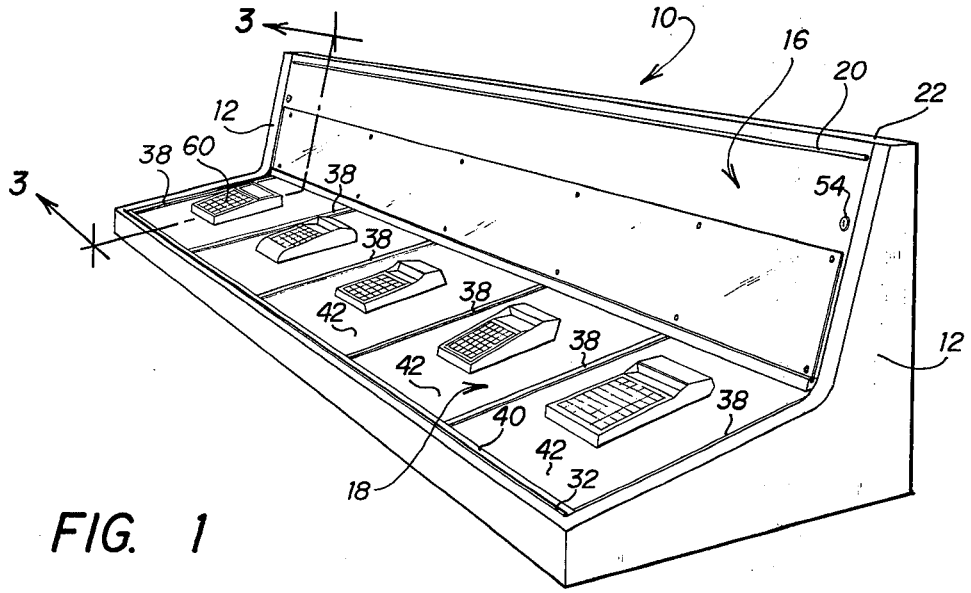
FIG. 1 is a perspective view of one embodiment of the present invention.
Figure 2:
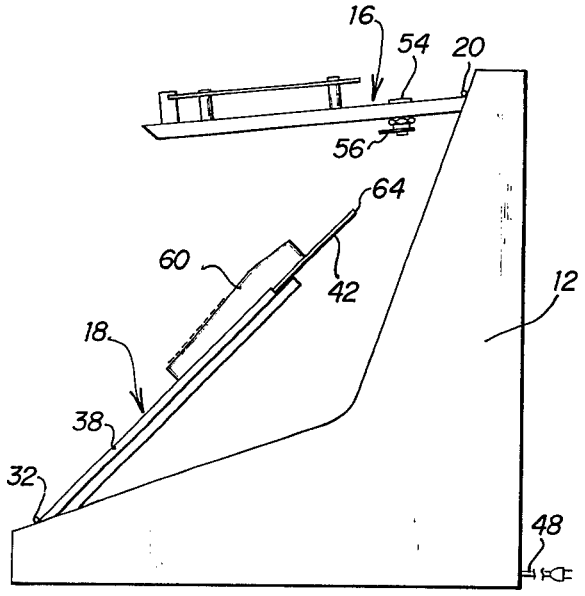
FIG. 2 is an elevational view of an end of the embodiment shown in FIG. 1 with the front panel and display shelf in a partially pivoted position.
Figure 3:
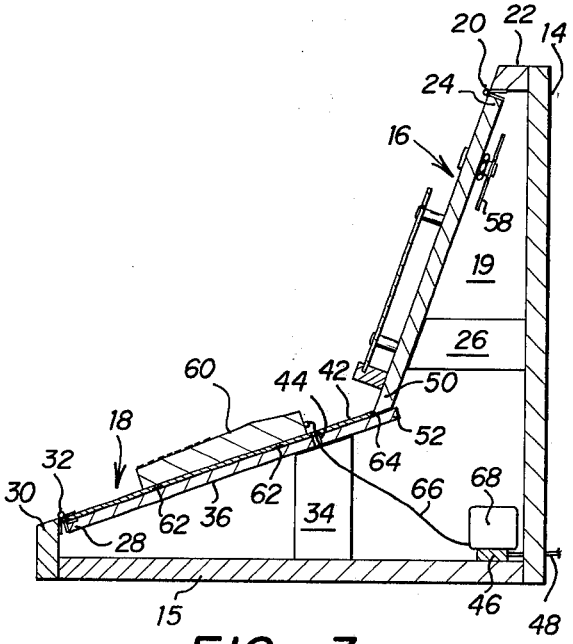
FIG. 3 is a cross-sectional view of the embodiment of FIG. 1 taken along line 3—3 of FIG. 1.

To display properly certain types of merchandise to prospective customers it is necessary to permit the customer to have access to the merchandise in order that he may examine and operate the merchandise. For example, in the sale of electronic calculators it is desirable to provide the customer access to the calculator in order that he may use the calculator in determining whether it functions in a manner which he desires and to permit him to observe the operation of the calculator. Because of the relatively high cost of such items it also is desirable to provide security for the merchandise to prevent its theft. Such security is normally provided by requiring that sales personnel be present during customer usage of the merchandise. However, this is relatively expensive and limits the availability of the salesman to other customers who may be shopping for other items. The present invention provides a display stand which will permit prospective customers to operate or otherwise inspect the merchandise without requiring the presence of sales personnel and without risking theft of the merchandise. To be more particular, reference is made to the drawings which illustrate a preferred embodiment of the invention. With particular reference to FIG. 1, the display stand 10 includes a pair of end walls 12, a back wall 14, a bottom 15, a front panel 16 and a display shelf 18 which form an enclosure having an interior space 19. The front panel 16 is pivotally attached along its top edge to lip 22 of back wall 14 by hinge 20 which runs the length of the top edge 24 of panel 16. Hinge 20 permits pivotal movement of the panel 16 between a first position illustrated in FIGS. 1 and 3 and a second position, such as illustrated in FIG. 2. Panel 16 is limited in its downward movement, as illustrated in FIG. 3, by stops 26 which take the form of boards 26 affixed to the interior surfaces of end walls 12. Its movement in the opposite direction will, of course, be limited by the abutment of panel 16 with the lip 22 of back wall 14. The display shelf 18 is pivotally attached along its bottom edge 28 to the upwardly extending lip 30 of bottom 15 by a hinge 32. The shelf 18 is supported in its first position by a pair of stops 34 which take the form of boards affixed to the interior surface of end walls 12. The display shelf 18 comprises a base 36 which extends between end walls 12 and has secured thereto at intervals along the length thereof extruded channels 38 and along the bottom edge thereof extruded channel 40 which cooperate to form a channel or track within which may be positioned a relatively thin panel 42. Both the base 36 and panel 42 are provided with registering apertures 44. The interior of display stand 10 contains a source of electrical power which takes the form of a conventional AC outlet 46 which through an electrical conductor 48 extends through the back wall 14 and may be connected to any conventional wall outlet for AC power. It can be observed from FIG. 3 that, when the top panel 16 and display shelf 18 are in their first positions, they overlap. Specifically, the bottom edge 50 of the top panel 16 will overlap the top edge 52 of display shelf 18. The panel 16 and shelf 18 may be temporarily secured in this position by a conventional key operated rotatable lock 54 having an elongated finger 56 which when lock 54 is rotated to the locked position engages a slot 58 cut in the end wall 12. When so engaged the finger 56 cannot be withdrawn from slot 58 and thus panel 16 and display shelf 18 may not be moved relative to each other.

If the article of merchandise to be displayed by display stand 10 is an electronic calculator, for example, the article may be affixed to the panel 42 by unlocking top panel 16 and rotating it to a position such as shown in FIG. 2. The display shelf 18 is then pivoted upwardly and the panel 42 withdrawn from the extruded channels 38 and extruded channel 40. The calculator, as for example calculator 60, may then be affixed to panel 42 as by passing screws 62 through the bottom of panel 42 into threaded recesses provided in the bottom of the calculator. The panel 42 may than be reinserted into the channels 38 and 40 and the display shelf 18 pivoted to the position shown in FIGS. 1 and 3. The top panel 16 may then be pivoted downwardly to its first position and the lock 54 operated to lock the top panel 16 in its first position. If power is to be provided to the calculator 60, before locking of the top panel 16 and movement of the display shelf 18 to its first position, the charging unit 68 of the calculator may be inserted into the source of electrical power 46 and the charging conductor 66 passed through apertures 44 in base 36 and panel 42 and attached to the receptacle provided in calculator 60.

With the display stand 10 it is possible to display relatively expensive items of merchandise which customers may be expected to operate without risking theft of the articles because in the locked position shown in FIG. 3 the calculator 60 may not be easily removed from panel 42 because it is attached thereto by the screws 62 and panel 42 is affixed to the base 36 by extruded channels 38 and 40. Movement of panel 42 on base 36 is prohibited by the top panel 16 which overlaps the top end 52 of base 36 and the top end 64 of panel 42 preventing a customer from withdrawing the item of merchandise from the display stand.

Another form of embodiment which could be utilized involves forming the lip 30 of bottom 15 and shelf 18 as an integral or rigidly integrated unit which could be slidably mounted relative to end walls 12 in slots provided in end walls 12. Such mounting would permit withdrawal of the panel 18 and lip 30 from the display stand 10. After attachment of the items of merchandise the panel 18 and lip 30 could be reinserted and a suitable lock means which could, for example, pass through lip 30 into base 15 operated to secure the display shelf in a fixed position.

Other forms of the invention will suggest themselves to those skilled in the art after a reading of the above. Therefore, while rather specific terms have been used to describe a preferred embodiment of the invention they are not intended nor should they be construed as a limitation upon the invention as defined by the appended claims.

What is claimed is:

1. A display stand for merchandise which prospective customers may be expected to operate in order to test the suitability of the merchandise, the display stand comprising:

a housing having a display shelf which forms part of the housing and is so oriented that merchandise may be displayed upon the top surface of the shelf;

means for mounting the display shelf to the housing to permit the shelf to be moved between a first position which permits access to the bottom surface of the shelf and a second position in which the bottom surface of the shelf is inaccessible, securing means adapted to temporarily affix the merchandise to the display shelf so that a prospective customer has physical access to the merchandise, which securing means is positioned beneath the top surface of said shelf and is accessible when said shelf is in the first position and cannot be removed by the prospective customer when the display shelf is in the second position to prevent removal of the merchandise from the shelf by the prospective customer, said display shelf comprising:

a base;

a panel to which said articles of merchandise may be mounted; and means for attaching said panel to said base which permits said panel to be removed from said base when said display shelf is in said first position to permit attachment of the articles of merchandise to the panel and returned to and securely attached to the base after attachment of the article of merchandise to the panel.

2. The display stand of claim 1 in which said housing includes a source of electrical power and the display shelf is provided with an aperture to permit communication of the electrical power from the interior of the housing to an article of merchandise secured to the top surface of the display shelf.

3. The display stand of claim 1 wherein said housing includes a source of electrical power and said panel and base are provided with apertures which permit communication of such power to articles of merchandise mounted to the panel.

4. A display stand for merchandise which prospective customers may be expected to operate in order to test the suitability of the merchandise, the display stand comprising:

a housing having adjoining back and end walls;

a front panel pivotally mounted at its top edge to permit the bottom edge of the front panel to be moved between a first and second position;

a display shelf pivotally mounted along its bottom edge to permit the top edge to be moved between a first position and a second position, the top edge of said display shelf and the bottom edge of said front panel being adapted to overlap and when both are in their first positions to complete the housing;

means for temporarily securing one of said panel or shelf when they are in the overlapping first position to preclude access to the interior of the housing; and securing means adapted to temporarily affix the merchandise to the display shelf so that a prospective customer has physical access to the merchandise, which securing means is positioned beneath the top surface of said shelf and is accesible when said self is in the first positon and cannot be removed by the prospective customer when the display shelf is in the second position to prevent removal of the merchandise from the shelf by the prospective customer.

5. The display stand of claim 4 wherein said housing includes a source of electrical power and the display shelf is provided with an aperture to permit communication of the electrical power from the interior of the housing to an article of merchandise secured to the top surface of the display shelf.

6. The display stand of claim 4 wherein said display shelf comprises:

a base;

a panel to which said articles of merchandise may be mounted; and means for attaching said panel to said base which permits said panel to be removed from said base when said display shelf is in said first position to permit attachment of the articles of merchandise to the panel and returned to and securely attached to the base after attachment of the article of merchandise to the panel.

7. The display stand of claim 6 wherein said housing includes a source of electrical power and said panel and base are provided with apertures which permit communication of such power to articles of merchandise mounted on the panel.

* * * * *